US009644481B2

(12) United States Patent
Forssell et al.

(10) Patent No.: US 9,644,481 B2
(45) **Date of Patent: *May 9, 2017**

(54) GEROTOR HYDRAULIC DEVICE WITH ADJUSTABLE OUTPUT

(75) Inventors: Jonas Forssell, Torslanda (SE); Christer Odenmarck, Torslanda (SE); Lewis Kasper, Poland, OH (US); Steve White, Kings Mountain, NC (US); Tom Roeber, Yarmouth, ME (US); Karl-Erik Rydberg, Linkoping (SE)

(73) Assignee: Volvo Car Corporation, Gothenburg (SE)

( * ) Notice: Subject to any disclaimer, the term of this patent is extended or adjusted under 35 U.S.C. 154(b) by 789 days.

This patent is subject to a terminal disclaimer.

(21) Appl. No.: 14/001,669

(22) PCT Filed: Mar. 8, 2012

(86) PCT No.: PCT/EP2012/054037

§ 371 (c)(1),
(2), (4) Date: Mar. 25, 2014

(87) PCT Pub. No.: WO2012/120095

PCT Pub. Date: Sep. 13, 2012

(65) Prior Publication Data

US 2014/0219852 A1 Aug. 7, 2014

(30) Foreign Application Priority Data

Mar. 9, 2011 (EP) ..... 11157522

(51) Int. Cl.
*F04C 14/24* (2006.01)
*F01C 1/22* (2006.01)
(Continued)

(52) U.S. Cl.
CPC ..... *F01C 20/24* (2013.01); *F01C 1/22* (2013.01); *F04C 2/10* (2013.01); *F04C 2/103* (2013.01);
(Continued)

(58) Field of Classification Search
CPC .... F04C 14/14; F04C 14/24; F04C 2240/603; F04C 2/10; F04C 2/103; F01C 1/22; F01C 20/24
(Continued)

(56) References Cited

U.S. PATENT DOCUMENTS 3,175,504 A * 3/1965 Molly ..... F04C 2/104 418/61.3
3,698,841 A * 10/1972 Lusziig ..... F04C 2/105 418/61.3
(Continued)

FOREIGN PATENT DOCUMENTS

DE 879 942 C A 6/1953
GB 768 933 A 2/1957
(Continued)

OTHER PUBLICATIONS

International Search Report for International Application No. PCT/EP2012/054037 dated May 22, 2013.

*Primary Examiner* — Mary A Davis
(74) *Attorney, Agent, or Firm* — Renner, Otto, Boisselle & Sklar, LLP

(57) ABSTRACT

A hydraulic device (1) comprising a housing (2) and a gerotor (3) contained within the housing (2), the gerotor (3) having an inner rotor (4) eccentrically disposed within an outer ring (5), the outer ring having a central axis (19), the outer ring (5) being fixed to the housing, the inner rotor (4) having external lobes (4*a*) extending radially outwardly
(Continued)

engaging the outer ring (5) having internal lobes (5*a*) extending radially inwardly, the inner rotor (4) being arranged for orbital and rotational movement relative the outer ring (5), wherein the orbital and rotational movement will define a plurality of expanding and contracting volume pressure chambers (7) between the inner rotor (4) and the outer ring (5). The hydraulic device (1) comprises a fluid feeder tube (8) with a central axis (19), the fluid feeder tube (8) is provided with at least one fluid inlet line (8*a,* 8*c*) and at least one fluid outlet line (8*b,* 8*d*), the inner rotor (4) is adapted to slide against a drive shaft cylinder (10*b*), the drive shaft cylinder (10*b*) having a circumference which is eccentrically disposed relative the central axis (19), the inner rotor (4) comprises at least one radial fluid feeder channel (9) disposed radially from the center of and through the inner rotor (4) and out to at least one of the plurality of expanding and contracting volume pressure chambers (7), wherein said fluid inlet line (8*a,* 8*c*) and said fluid outlet line (8*b,* 8*d*) respectively are radially connectable to said radial fluid feeder channel (9) for fluid communication into and out from said expanding and contracting volume pressure chambers (7).

22 Claims, 8 Drawing Sheets

(51) Int. Cl.

| | |
|---|---|
| ***F04C 2/10*** | (2006.01) |
| ***F04C 14/14*** | (2006.01) |
| ***F01C 20/24*** | (2006.01) |
| ***F04C 15/00*** | (2006.01) |

(52) U.S. Cl.
CPC ..... *F04C 14/14* (2013.01); *F04C 14/24* (2013.01); *F04C 15/0076* (2013.01); *F04C 2240/603* (2013.01)

(58) Field of Classification Search
USPC ..... 418/61.3, 183–188
See application file for complete search history.

(56) References Cited

U.S. PATENT DOCUMENTS

| | | | | | |
|---|---|---|---|---|---|
| 3,872,838 | A * | 3/1975 | Vogelsang | F01C 19/04 | 418/61.3 |
| 3,883,276 | A * | 5/1975 | Hofbauer | F01C 1/104 | 418/61.3 |
| 3,917,437 | A * | 11/1975 | Link | F01C 1/104 | 418/61.3 |
| 3,985,476 | A * | 10/1976 | Hofbauer | F02B 53/06 | 418/61.3 |
| 4,187,062 | A * | 2/1980 | Traut | F01C 1/104 | 418/61.3 |
| 7,637,725 | B2 * | 12/2009 | Berger | F04C 14/14 | 418/61.3 |
| 9,377,033 | B2 * | 6/2016 | Forssell | F04C 14/14 | |
| 2002/0076345 | A1 | 6/2002 | Hansen | | |
| 2014/0083086 | A1 * | 3/2014 | Forssell | F04C 14/14 | 418/61.3 |

FOREIGN PATENT DOCUMENTS

| | | | |
|---|---|---|---|
| GB | 793 089 | A | 4/1958 |
| JP | 52067008 | A * | 6/1977 |

* cited by examiner

GEROTOR HYDRAULIC DEVICE WITH ADJUSTABLE OUTPUT

TECHNICAL FIELD

The present invention relates to the field of hydraulic devices, such as gerotors and especially their application in transmission systems.

BACKGROUND ART

Today, there exist various examples of hydraulic devices for directing fluids, such as pumps or motors, comprising a plurality of expanding and contracting volume pressure chambers defined by interacting lobes of a gerotor. Gerotors are well known fluid directing units and typically comprise a hollow outer ring provided with internal lobes and an inner rotor provided with external lobes.

Today, there exist two types of gerotors, which are Low Speed High Torque (LSHT) gerotors and High Speed Low Torque (HSLT) gerotors.

For the LSHT gerotors, the outer ring is stationary and the inner rotor is located within the outer ring. The inner rotor has one less lobe than the outer ring and has an axis of rotation which is offset or eccentric relative to an axis of the outer ring. The inner rotor is eccentrically disposed within the outer ring. The inner rotor is mounted for rotational and orbital movement relative the outer ring and is supported and guided in such a movement by the lobes of the outer ring. The interacting external and internal lobes of the inner rotor and the outer ring define a plurality of volume pressure chambers which expand and contract during the movement of the inner rotor. These known LSHT gerotors are restricted to a slow rotation speed of the drive shaft. Thus, the inner rotor rotates several revolutions before the drive shaft has rotated one revolution. These known LSHT gerotors comprises separate valve constructions for directing fluids. A further weakness of these types of gerotors is that they comprise oscillating parts resulting in vibrations and noise. These solutions are restricted to comprising several parts which provide a heavy and bulky solution. Further, these known solutions are restricted to solutions with a high cost comprising of several expensive and complex parts.

For the HSLT gerotors, the outer ring rotates simultaneously with the inner rotor. The inner rotor rotates around a fixed axis and the outer ring slides within a housing. These known HSLT gerotors needs a wide gap between the housing and the lobes of the inner rotor and the outer ring. Thus, these known solutions result in a high leakage and low efficiency. These existing solutions provide constant efficiency losses and fluid leakage at high pressure. These existing solutions provide high sliding speed, providing efficiency losses.

There is thus a need for an improved hydraulic device removing the above mentioned disadvantages.

DESCRIPTION OF INVENTION

The object of the present invention is to suggest a compact, easy to implement hydraulic device arranged to regulate the effective pump or motor displacement of the hydraulic device by providing the ability to control and direct the fluid flow within the hydraulic device.

The present invention is defined by the appended independent claims. Various examples of the invention are set forth by the appended dependent claims as well as by the following description and the accompanying drawings.

With the above description in mind, then, an aspect of the present invention is to provide an improved solution of controlling and directing the fluid flow to and from a gerotor in the hydraulic device which seeks to mitigate, alleviate, or eliminate one or more of the above-identified deficiencies in the art and disadvantages singly or in any combination.

The object of the present invention is to provide an inventive hydraulic device, such as a hydraulic pump or motor, for controlling, directing and partially recirculating the fluid flows and thereby be able to regulate the effective pump or motor displacement of the hydraulic device. The fluid flow is controlled by recirculating of the fluid.

The object is achieved by the features of claim 1 wherein, a hydraulic device comprising a housing and a gerotor contained within the housing, the gerotor having an inner rotor eccentrically disposed within an outer ring, the outer ring having a central axis, the outer ring being fixed to the housing, the inner rotor having external lobes extending radially outwardly engaging the outer ring having internal lobes extending radially inwardly, the inner rotor being arranged for orbital and rotational movement relative the outer ring, wherein the orbital and rotational movement will define a plurality of expanding and contracting volume pressure chambers between the inner rotor and the outer ring; characterized in that, the hydraulic device comprises a fluid feeder tube with a central axis, the fluid feeder tube is provided with at least one fluid inlet line and at least one fluid outlet line, the inner rotor is adapted to slide against a drive shaft cylinder, the drive shaft cylinder having a circumference which is eccentrically disposed relative the central axis, the inner rotor comprises at least one radial fluid feeder channel disposed radially from the centre of and through the inner rotor and out to at least one of the plurality of expanding and contracting volume pressure chambers, wherein said fluid inlet line and said fluid outlet line respectively are radially connectable to said radial fluid feeder channel for fluid communication into and out from said expanding and contracting volume pressure chambers.

The outer ring in the inventive hydraulic device is arranged to be stationary. Whereby, the inventive hydraulic device can be compactly arranged and sealed, especially between the inner rotor and to the sides of the inner rotor. The hydraulic device is arranged to control and direct the fluid flow to and from the gerotor. The gerotor serves as a fluid displacement mechanism. The hydraulic device is a variable radial fluid feeder drive/pump unit providing a variable displacement providing variable torque and motor speed or variable pump fluid flow. When the input fluid flow and pressure is constant, the torque and motor speed can be varied to meet load requirements by varying the displacement. When the torque and motor speed is constant, the fluid flow and pressure can be varied by varying the displacement. The expanding and contracting volume pressure chambers are defined between each of the inner rotor external lobes and a portion of the outer ring between two internal lobes.

The hydraulic device comprises a drive shaft unit which comprises a drive shaft extending from the gerotor having an axis of rotation aligned with the central axis and a drive shaft cylinder. The plurality of expanding and contracting volume pressure chambers between the inner rotor and the outer ring has a high pressure section and a low pressure section. The high pressure section of the plurality of expanding and contracting volume pressure chambers is located in front of the point on the drive shaft cylinder, which is furthest away from the central axis. Hence, the low pressure section is thereby located behind the point on the drive shaft cylinder, which is furthest away from the central axis. Wherein in front of is in the direction of rotation of the central axis, and behind is in the opposite direction of the direction of rotation of the drive shaft. The hydraulic device comprises seals on the drive shaft unit in the interface towards the inner rotor.

The inner rotor is provided with radial fluid feeder channels extending from the drive shaft cylinder to the expanding and contracting volume pressure chambers. A pressure medium, such as for example a fluid, used in the hydraulic device functioning as a pump is thereby sucked into the expanding volume pressure chambers through the radial fluid feeder channels in the low pressure section, and pressed out through the radial fluid feeder channels in the high pressure section. When the hydraulic device is functioning as a motor the fluid is fed into the expanding volume pressure chambers through the radial fluid feeder channels in the high pressure section, and pushed out through the radial fluid feeder channels in the low pressure section.

By opening, closing, or partially obstructing various radial passageways between the fluid feeder tube disposed within the inner rotor and the plurality of expanding and contracting volume pressure chambers disposed between the inner rotor and the outer ring, the effective pump or motor displacement of the hydraulic device can be regulated. The inventive hydraulic device provides an improved packaging freedom and space due to the hydraulic device being a compact and robust solution having few parts.

The inner rotor may comprise several radial fluid feeder channels. Normally, the inner rotor comprises at least one fluid feeder channel between every external lobe of the inner rotor. Preferably, the inner rotor comprises four radial fluid feeder channels between every external lobe of the inner rotor.

These radial fluid feeder channels may be varied in shape and size.

According to a further advantageous aspect of the invention, the hydraulic device comprises fluid regulating means comprising fluid openings adapted to connect and disconnect said fluid inlet line and said fluid outlet line to said radial fluid feeder channel. The hydraulic device provides a solution having discrete fluid regulating means providing discrete gear adjustment. By opening and closing certain fluid openings of the fluid regulating means, the radial fluid feed can be partially recirculated. Whereby, the effective pump or motor displacement of the hydraulic device can be regulated. The fluid feeder tube may be split into four symmetrical alternating fluid inlet lines and fluid outlet lines. Whereby, force and pressure balance inside the hydraulic device are substantially compensated for, especially between the fluid feeder tube and the fluid regulating means.

According to a further advantageous aspect of the invention, the fluid regulating means comprising the fluid feeder tube, an inner control sleeve and an outer control sleeve and a drive shaft cylinder. The fluid regulating means are arranged to be mounted within the gerotor. Whereby, the hydraulic device is compact, especially in axial direction, and robust. The hydraulic device may comprise one or more control sleeves.

According to a further advantageous aspect of the invention, the inner control sleeve and the outer control sleeve are provided between the fluid feeder tube and the inner rotor, wherein the inner control sleeve and the outer control sleeve are displaceable and arranged to radially connect said fluid inlet line and said fluid outlet line to said radial fluid feeder channel to allow for a regulated radial fluid feed through the inner rotor to said expanding and contracting volume pressure cambers. The inner control sleeve comprises an inner control sleeve end gear and the outer control sleeve comprises an outer control sleeve end gear.

By turning the inner control sleeve end gear and the outer control sleeve end gear, the inner and outer control sleeves can be rotated around the fluid feeder tube. The inner control sleeve end gear and the outer control sleeve end gear can be turned by using an electric motor, such as a stepper motor. Steering devices may be connected to the inner control sleeve end gear and the outer control sleeve end gear, in which the inner control sleeve end gear and the outer control sleeve end gear may be turned, whereby the inner and outer control sleeves are rotated. The inner control sleeve end gear and the outer control sleeve end gear may be turned using hydraulics. By rotating the inner and outer control sleeve the radial fluid feed can be controlled and directed from the fluid feeder tube to the volume pressure chambers and then back to the fluid feeder tube. The inner and outer control sleeves are rotated relative each other to regulate the radial fluid flow in the hydraulic device. The present invention provides a robust and compact hydraulic device having fluid regulating means within the gerotor enabling high efficiency.

According to a further advantageous aspect of the invention, the inner control sleeve comprises inner fluid openings and the outer control sleeve comprises outer fluid openings adapted to connect and disconnect said fluid inlet line and said fluid outlet line to said radial fluid feeder channel. The inner and outer control sleeves are turned to decide if a high pressure or a low pressure fluid inlet or fluid outlet line should be in contact with a certain inner fluid or outer fluid opening or openings. The radial fluid feed is regulated by opening and closing the fluid openings of the inner and outer control sleeves. The fluid inlet lines communicate with their corresponding fluid openings in the rotating drive shaft cylinder and the fluid outlet lines communicate with their corresponding fluid openings in the drive shaft cylinder.

According to a further advantageous aspect of the invention, the inner and outer control sleeves are displaceable around said fluid feeder tube. The inner and outer control sleeves may also be displaceable along said fluid feeder tube.

According to a further advantageous aspect of the invention, the inner and outer control sleeves are displaceable to a first position in which said fluid inlet line is closed. During this first position of the inner and outer control sleeves no fluid is radially fed from said fluid inlet line in the fluid feeder tube to the volume pressure chambers between the inner rotor and the outer ring. This first position equals no fluid flow from the inlet lines. At least one opening is always in communication with either a fluid inlet or fluid outlet line.

According to a further advantageous aspect of the invention, the outer and inner control sleeves are displaceable to a second position in which a first fluid inlet opening is open to said fluid inlet line. During this second position of the inner and outer control sleeves fluid is radially fed from said fluid inlet line in the fluid feeder tube to the volume pressure chambers between the inner rotor and the outer ring. This second position equals a first displacement, wherein one opening is letting fluid to flow radially from the inlet line.

According to a further advantageous aspect of the invention the inner and outer control sleeves are displaceable to a third position in which a second fluid inlet opening is open to said fluid inlet line. During this third position of the inner and outer control sleeves fluid is radially fed from said fluid inlet line in the fluid feeder tube to the volume pressure chambers between the inner rotor and the outer ring. This third position equals a second displacement, wherein one opening, which is larger than the opening in the first displacement, is letting fluid to flow radially from the inlet line.

According to a further advantageous aspect of the invention the inner and outer control sleeves are displaceable in a fourth position in which a first fluid inlet opening and a second fluid inlet opening are open to said fluid inlet line. During this fourth position of the inner and outer control sleeves fluid is radially fed from the fluid inlet line in the fluid feeder tube to the volume pressure chambers between the inner rotor and the outer ring. This fourth position equals a third displacement, i.e. both the openings in for the first and second displacements are letting fluid to flow radially from said fluid inlet line.

Thereby, the radial fluid flow through the hydraulic device can be regulated by connecting the fluid feeder tube to the expanding and contracting volume pressure chambers by opening and closing radial fluid openings in the fluid directing means.

According to a further advantageous aspect of the invention, a drive shaft unit comprises a drive shaft extending from the gerotor and having an axis of rotation aligned with the central axis and a drive shaft cylinder, wherein the drive shaft cylinder is provided between said fluid feeder tube and the inner rotor, the drive shaft cylinder having a circumference which is eccentrically disposed relative said central axis, wherein the drive shaft cylinder is arranged to radially connect said fluid inlet line and said fluid outlet line to said radial fluid feeder channel to allow for a regulated radial fluid feed through the inner rotor to said expanding and contracting volume pressure cambers. Whereby, the inventive hydraulic device allow for a high rotational speed of the drive shaft. The inventive hydraulic device can provide a high rotational speed for the drive shaft due to the drive shaft cylinder connected to the drive shaft and due to the fact that the drive shaft cylinder slides relative the inner rotor. Whereby, the drive shaft rotates one revolution per revolution on the inner rotor. The drive shaft cylinder is non-symmetrical.

The drive shaft cylinder comprises a radial displacement around the fluid feeder tube, wherein the drive shaft cylinder has different radial extensions around and from the central axis. Whereby, the drive shaft cylinder and the inner rotor are eccentric relative the outer ring and the central axis. The inner rotor is arranged for orbital and rotational movement relative the outer ring and the central axis by having a non-symmetrical drive shaft cylinder in sliding contact with the inner rotor. The external lobes of the inner rotor have different radial extensions from the central axis due to the non-symmetrical drive shaft cylinder. The drive shaft cylinder is in sliding contact with the inner rotor. When the hydraulic device is a pump the drive shaft cylinder slides against the inner rotor displacing the inner rotor. When the hydraulic device is a motor the inner rotor slides against the drive shaft cylinder displacing the drive shaft cylinder. The inner rotor is in balance around the drive shaft cylinder due to flanges mounted on both sides of the inner rotor. Whereby, no pressure is applied by the inner rotor on the drive shaft cylinder, in which friction causing low efficiency can be avoided with the inventive hydraulic device. The drive shaft cylinder comprises cavities and seals for preventing leakage during the radial fluid feed.

According to a further advantageous aspect of the invention, the drive shaft cylinder is provided with at least one drive shaft cylinder opening to allow for a regulated radial feed through the inner rotor to said expanding and contracting volume pressure cambers. The drive shaft cylinder may comprise several different drive shaft cylinder openings. Normally, the drive shaft cylinder openings are of different size. Normally, the drive shaft cylinder comprises six drive shaft cylinder openings around the circumference of the drive shaft cylinder. Normally, the drive shaft cylinder openings around the drive shaft cylinder are arranged with an axial displacement to each other. Pressure zones caused by the fluid flow from the inlet lines rotate around the central axis together with the drive shaft cylinder.

According to a further advantageous aspect of the invention, seals are arranged between the drive shaft cylinder and the inner rotor. Whereby, leakage is prevented during the relative sliding between the drive shaft cylinder and the inner rotor. The hydraulic device comprises longitudinal seal vanes axially along the drive shaft cylinder and between the drive shaft cylinder openings. The hydraulic device comprises radial seal rings at the ends of the drive shaft cylinder.

According to a further advantageous aspect of the invention, the fluid feeder tube comprises at least one feeder tube fluid opening to allow for a radial fluid feed between said fluid inlet line and said fluid outlet line through the inner rotor to said expanding and contracting volume pressure cambers. The fluid outlet lines of the fluid feeder tube can comprise three radial fluid openings and the fluid inlet lines of the fluid feeder tube can comprise two radial fluid openings. However, the number radial fluid openings in the fluid feeder tube may be varied to achieve a desired number of gears for the hydraulic device.

According to a further advantageous aspect of the invention, the inner rotor have a sliding surface with a relatively small radius resulting in reduced sliding speed which results in high efficiency and reduced drag losses.

According to a further advantageous aspect of the invention, said fluid feeder tube comprises at least one fluid inlet port and at least one fluid outlet port to allow for a radial inlet and outlet feed of fluid. The fluid feeder tube can comprise two fluid inlet ports and two fluid outlet ports. The fluid inlet ports and the fluid outlet ports are axially displaced relative each other on the fluid feeder tube.

According to a further advantageous aspect of the invention, the fluid feeder tube is fixed to the housing.

According to a further advantageous aspect of the invention, said fluid inlet line and said fluid outlet line in the fluid feeder tube are symmetrical.

According to a further advantageous aspect of the invention, the fluid feeder tube comprises two fluid inlet lines and two fluid outlet lines.

According to a further advantageous aspect of the invention, said radial fluid feeder channel is disposed between the external lobes of said inner rotor.

According to a further advantageous aspect of the invention, the inner control sleeve and outer control sleeve are arranged to cooperate with the fluid feeder tube, the drive shaft unit and said radial fluid feeder channel to define a fluid recirculation region. Whereby, the fluid flow can be recirculated within the fluid recirculation region allowing regulating the effective pump or motor displacement. The flow length for the radial fluid feed from the fluid feeder tube is short during recirculation due to the radial fluid feed from and to the fluid feeder tube with a central axis common with the central axis of the outer ring. By being able to recirculate the fluid flow within the fluid recirculation region, the inventive hydraulic device is controllable with high efficiency.

According to a further advantageous aspect of the invention, the hydraulic device is a hydraulic motor. According to a further advantageous aspect of the invention, the hydraulic device is a hydraulic pump.

Any of the advantageous features of the present invention above may be combined in any suitable way.

A number of advantages are provided by means of the present invention, for example:

- a hydraulic device is obtained which allow for a combination of compact size, low manufacturing cost, and high torque;
- a hydraulic device is obtained which allow for low friction;
- a hydraulic device is obtained which allow for leakage control;
- a controllable hydraulic device with high efficiency is obtained;
- a hydraulic device is obtained which allow for low noise and low vibrations;
- a complete and compact hydraulic device is obtained comprising of few parts allowing for more packing freedom and space;
- a robust and simplified hydraulic device is obtained.

BRIEF DESCRIPTION OF THE DRAWINGS

The present invention will now be described in detail with reference to the figures, wherein.

It should be added that the following description of the examples is for illustration purposes only and should not be interpreted as limiting the invention exclusively to these examples/aspects.

DETAILED DESCRIPTION OF THE DRAWINGS

Examples of the present invention relate, in general, to the field of rotary fluid devices, in particularly, to hydraulic devices comprising gerotors. The present invention relates to a hydraulic device arranged to regulate the effective pump or motor displacement of a hydraulic device by providing the ability to control and direct the fluid flow within the hydraulic device.

Examples of the present invention will be described more fully hereinafter with reference to the accompanying drawings, in which examples of the invention are shown. This invention may, however, be embodied in many different forms and should not be construed as limited to the examples set forth herein. Rather, these examples are provided so that this disclosure will be thorough and complete, and will fully convey the scope of the invention to those skilled in the art. Like reference signs refer to like elements throughout.

Figure 1:
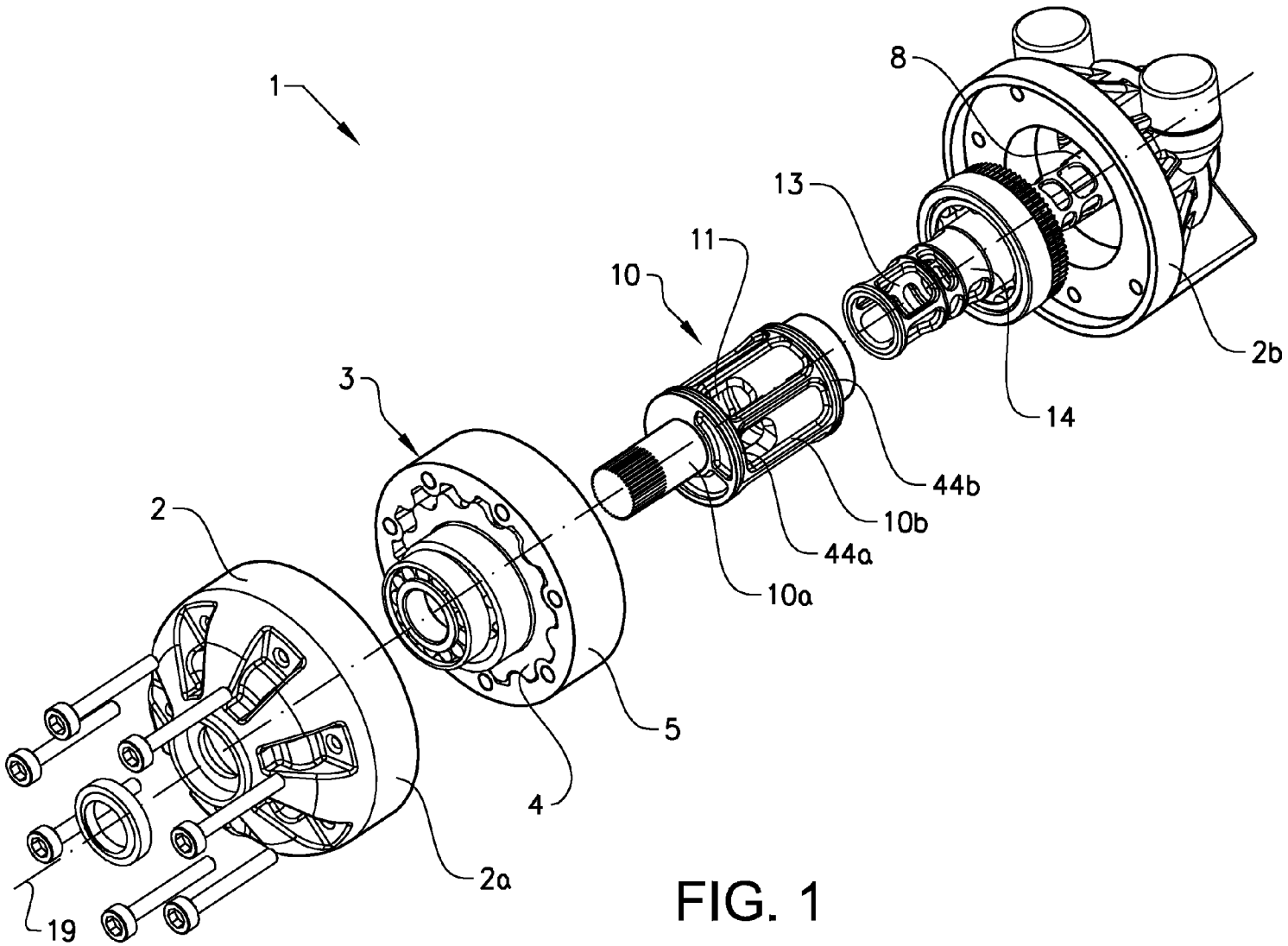
FIG. 1 shows a schematically exploded view of a hydraulic device according to the invention.

All the FIGS. 1 to 9*d* are schematically illustrated. FIG. 1 shows an example of the hydraulic device 1 according to the invention for directing and controlling the fluid flow. The present invention relates to an improved hydraulic device for directing and controlling the fluid flow to and from a plurality of volume pressure chambers within a gerotor.

Referring to FIG. 1, the hydraulic device 1 comprises a housing 2 and a gerotor 3. The hydraulic device 1 further comprises an inner control sleeve 13 and an outer control sleeve set 14, a drive shaft unit 10 and a fluid feeder tube 8. The housing 2 comprises a front housing 2*a* and a rear housing 2*b*. The front housing 2*a* is mounted to the rear housing 2*b* by a plurality of bolts. However, the front housing 2*a* can be mounted to the rear housing by any conventional fastening means such as for example screws. The fluid feeder tube 8 is fixed to the rear housing 2*b*.

The gerotor 3 comprises an inner rotor 4 and an outer ring 5. The inner rotor 4 is eccentrically disposed within the outer ring 5. The outer ring 5 has a central axis 19. The central axis 19 is aligned with the centre of the outer ring 5. The inner rotor is arranged to rotate in an orbital and rotational movement relative the outer ring 5. The inner rotor is arranged to rotate around its own axis which is eccentrically disposed relative the central axis 19 of the outer ring 5. The inner rotor 4 is arranged to rotate in an orbital movement around the central axis 19. The inner rotor 4 comprises external lobes extending radially outwardly. The outer ring 5 comprises internal lobes extending radially inwardly. Normally, the inner rotor 4 has one less external lobe than the outer ring 5.

During rotation of the inner rotor 4, the external lobes of the inner rotor 4 remain in contact with internal lobes of the outer ring 5 as the inner rotor 4 moves relative to the outer ring 5. This movement results in a continuous multi-location contact between the inner rotor 4 and the outer ring 5 creating fluid volume pressure chambers that sequentially expand and contract as the inner rotor 4 have a rotational and orbital movement with respect to the outer ring 5 and the central axis 19.

When the inner rotor 4 and its external lobes rotate, the volume pressure chambers between the inner rotor 4 and the outer ring 5 are varied causing the fluid to be compressed enabling the gerotor to act as a pump. Alternatively, a fluid may be forced into the volume pressure chamber between the inner rotor 4 and the outer ring 5 causing the gerotor to function as a motor, i.e. turning fluid flow pressure into mechanical rotation. The hydraulic device 1 is arranged to provide the ability to control the fluid flow through the gerotor 3 by providing for a radial fluid feed from the centre of the gerotor 3 through the inner rotor 4 and out to a volume pressure chambers between the inner rotor 4 and the outer ring 5. The hydraulic device 1 is arranged to provide the ability to partially recirculate the fluid flows and to regulate the effective pump or motor displacement by using the inner and outer control sleeves 13, 14.

The drive shaft unit 10 comprises a drive shaft 10*a* and a drive shaft cylinder 10*b*. The drive shaft 10*a* extends from the front housing 2*a* and has an axis of rotation which is aligned with the central axis 19. The drive shaft cylinder 10*b* is eccentrically connected to the drive shaft 10*a*. The drive shaft cylinder has a radial displacement around the fluid feeder tube, wherein the drive shaft cylinder has a different radial extension around and from the central axis 19. A seal can be provided between the drive shaft 10 and the front housing 2*a*. The centre of the drive shaft cylinder 10*b* is offset relative the central axis 19. This offset may be adjustable. The drive shaft cylinder 10*b* is arranged to be mounted between a fluid feeder tube 8 and the inner rotor 4, more particularly the drive shaft cylinder 10*b* is arranged to be mounted between the outer control sleeve 14 and the inner rotor 4. The drive shaft cylinder 10*b* comprises at least one radial fluid opening 11. The drive shaft cylinder 10*b* comprises annular seals 44*a*, 44*b* at the sides of the drive shaft cylinder 10*b* in the interface towards the inner rotor 4.

When the hydraulic device 1 functions as a motor, the rotation of the inner rotor 4 generated by the forced pressurized hydraulic fluid is output via the rotatable drive shaft 10*a* extending from the front housing 2*a*. A hydraulic motor can convert pressurized fluid flow into torque and speed for transferring rotational motion to a desired piece of machinery. When the hydraulic device 1 functions as a pump, the rotation of the inner rotor 4 is generated by the rotation of the drive shaft 10, i.e. mechanical energy is converted into to hydraulic fluid energy. The hydraulic device 1 may comprise flanges extending radially from both sides of the gerotor 3 providing stability to the hydraulic device 1. The hydraulic device 1 may comprise cam rings between the outer control sleeve and the drive shaft cylinder 10*b*. Whereby, these cam rings functions as seals.

The hydraulic device 1 according to the invention may comprise several control sleeves. The inner and outer control sleeves 13, 14 are displaceable around the fluid feeder tube 8. The inner and outer control sleeves 13, 14 are arranged to be rotatable around the fluid feeder tube 8. The inner and outer control sleeves 13, 14 may be turned while the hydraulic device 1 is running. The amount of fluid flowing into the hydraulic device 1 may be varied while the hydraulic device 1 is running.

Figure 2:
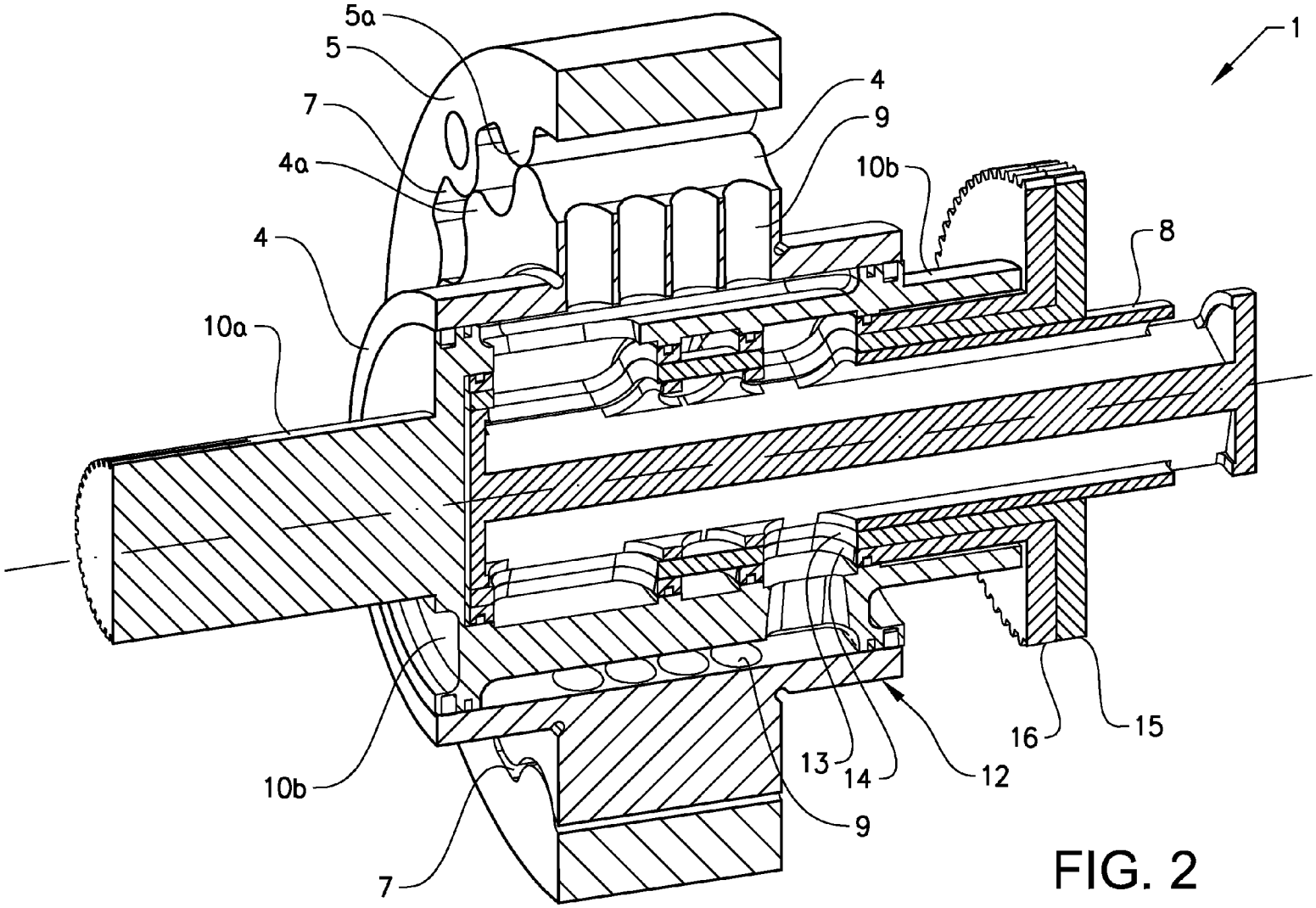
FIG. 2 shows a schematically cross section view of a hydraulic device according to the invention.

FIG. 2 shows a cross section of an example of the hydraulic device 1 according to the invention for directing and controlling the fluid flow. FIG. 2 shows the outer ring 5 having internal lobes 5*a*, the inner ring 4 having external lobes 4*a*, the inner control sleeve 13 and the outer control sleeve 14. The drive shaft cylinder 10*b* and the inner control sleeve 13 and the outer control sleeve 14 are mounted in between the fluid feeder tube 8 and the inner rotor 4, more particularly the inner and outer control sleeves 13, 14 are arranged to be mounted between the drive shaft cylinder 10*b* and the fluid feeder tube 8. The drive shaft cylinder 10*b* and the inner control sleeve 13 and the outer control sleeve 14 are arranged and displaceable to radially connect the fluid feeder tube with the radial fluid feeder channels 9.

The inner control sleeve 13 comprises an inner control sleeve end gear 15. The outer control sleeve 14 comprises an outer control sleeve end gear 16. By altering the inner control sleeve end gear 15 and the outer control sleeve end gear 16, the inner and outer control sleeves 13, 14 are rotated around the fluid feeder tube 8 regulating the fluid flow. The inner and outer control sleeves 13, 14 can be turned by an electric motor (not shown), for example over a worm gear (not shown) connecting to the outer circumference of the inner and outer control sleeve end gears 15, 16.

Referring to FIG. 2, four radial fluid feeder channels 9 are disposed between each of the external lobes 4*a* of the inner rotor 4. The size, shape and number of fluid feeder channels 9 between the external lobes 4*a* of the inner rotor 4 may be varied. Preferably, radial fluid feeder channels 9 are disposed between all of the external lobes 4*a* of the inner rotor 4. The inner rotor 4 may comprise one radial fluid feeder channel between all of the external lobes 4*a*. The radial fluid feeder channels may be square channels.

The inner and outer control sleeves 13, 14 are arranged to cooperate with the fluid feeder tube 8, the drive shaft cylinder 10*b* and said radial fluid feeder channel 9 to define a fluid recirculation region 12.

Referring to FIG. 2, orbital and rotational movement of the inner rotor 4 will define a plurality of expanding and contracting volume pressure chambers 7 between the inner rotor 4 and the outer ring 5.

Figure 3:
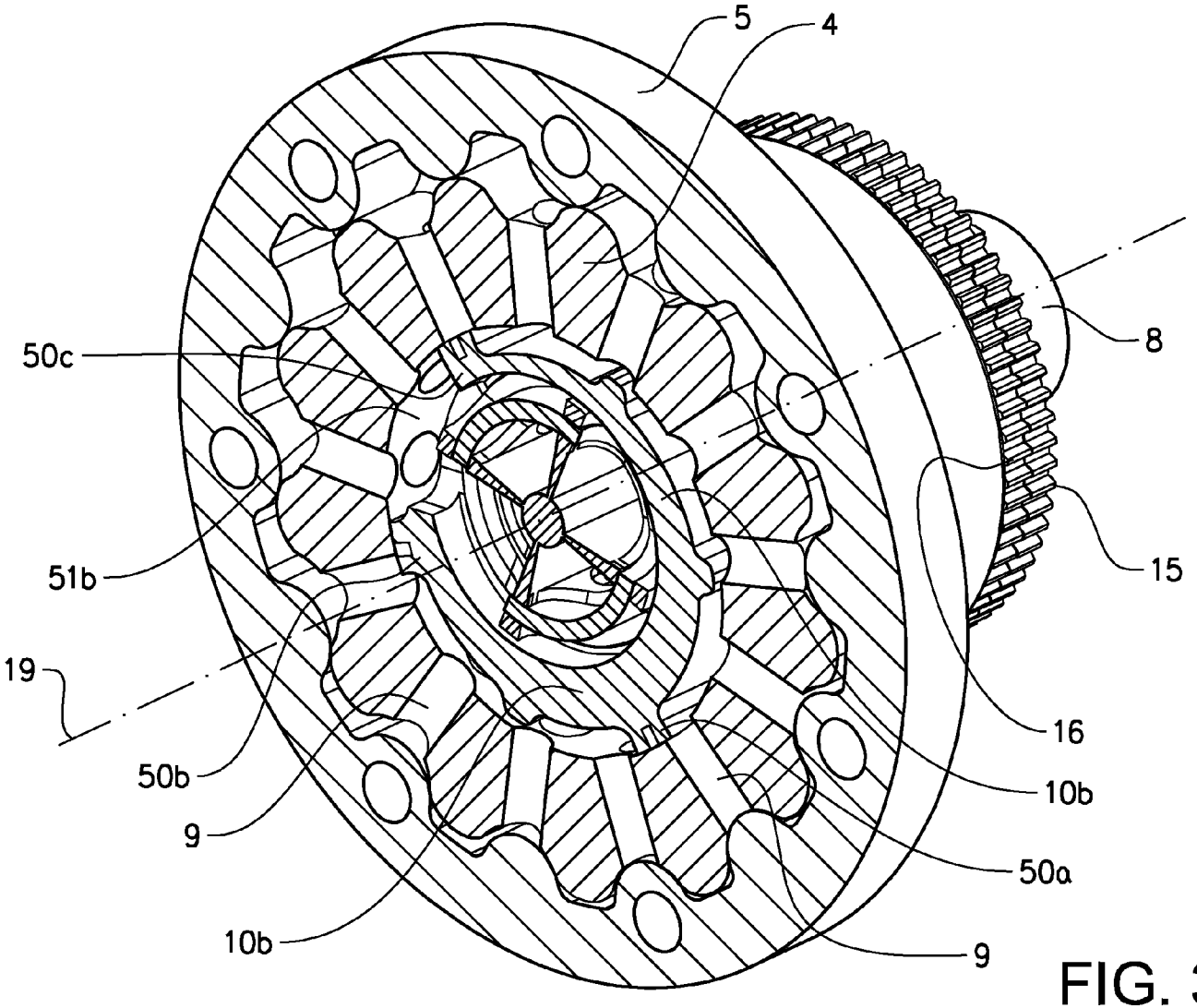
FIG. 3 shows a schematically cross section view of a gerotor according to the invention.

FIG. 3 shows a cross section of the gerotor 3 according to the invention for directing and controlling the fluid flow. The outer ring 5 has a central axis 19.

The drive shaft cylinder 10*b* comprises a first vane 50*a*, a second vane 50*b* and a third vane 50*c*. The drive shaft cylinder 10*b* slides on the first vane 50*a*, the second vane 50*b* and the third vane 50*c*, which seals between the fluid feeder tube 8 and the inner rotor 4. The vanes 50*a*, 50*b*, 50*c* seals and as the drive shaft cylinder 10*b* rotates the vanes 50*a*, 50*b*, 50*c* seals and pushes the fluid between the inner rotor 4 and the drive shaft cylinder 10*b* in the rotation direction of the drive shaft cylinder 10*b*.

The first vane 50*a* is the point on the drive shaft cylinder 10*b* which is furthest away from the central axis 19. The high pressure section of the plurality of expanding and contracting volume pressure chambers is located in front of the first vane 50*a*. The low pressure section is located behind the first vane 50*a*. Wherein in front of is in the direction of rotation of the central axis 19, and behind is in the opposite direction of the direction of rotation of the drive shaft unit 10. The third vane 50*c* is the point on the drive shaft cylinder 10*b* which is closest to the central axis 19, and the second vane 50*b* is between the first vane 50*a* and the third vane 50*c*.

FIG. 3 shows an example according to the invention, where at a high pressurised vane volume 51*b*, between the second vane 50*b* and the third vane 50*c*, where the fluid flow from the inlet lines, the area between the drive shaft cylinder 10*b* and the inner rotor 4 correspond to a pressurized area between the inner rotor 4 and the outer ring 5. Whereby, all radial forces on the inner rotor 4 eliminate each other and only the forces on the drive shaft cylinder 10*b* and reaction forces on the outer ring 5 remain. It is the force on the drive shaft cylinder 10*b* that creates torque speed on the drive shaft 10*a*.

Figures 4, 5:
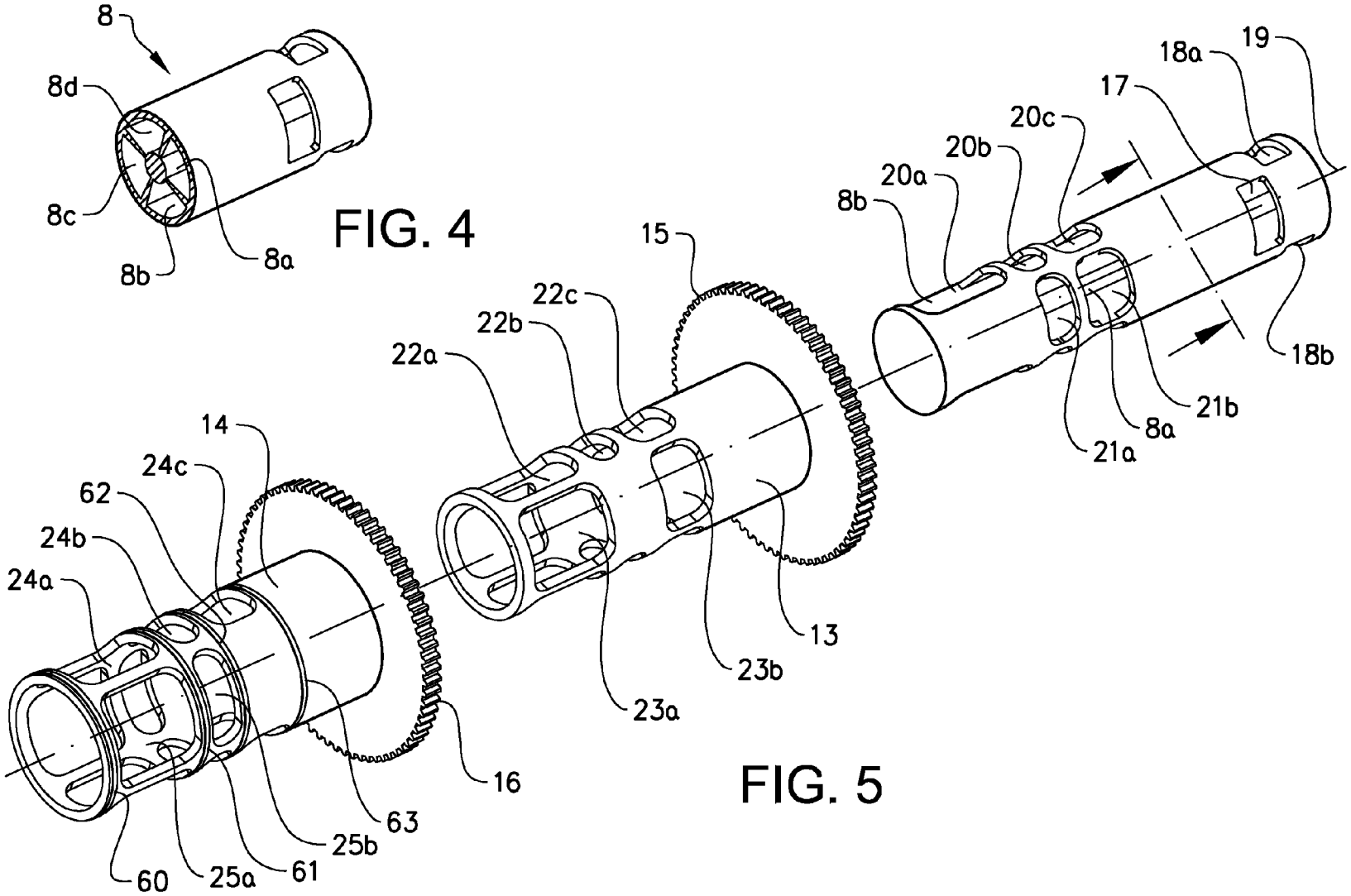
FIG. 4 shows a schematically cross section view of a fluid feeder tube according to the invention.
FIG. 5 shows a schematically exploded view of a fluid feeder tube and inner and outer control sleeves according to the invention.

FIG. 4 shows a cross section view of a fluid feeder tube 8 according to the invention having a central axis 19. The fluid feeder tube 8 comprises two fluid inlet lines 8*a*, 8*c* and two outlet lines 8*b*, 8*d*. Preferably, the fluid inlet lines 8*a*, 8*c* and the fluid outlet lines 8*b*, 8*d* are symmetrical. However, the fluid inlet lines 8*a*, 8*c* and the fluid outlet lines 8*b*, 8*d* may be non-symmetrical with each other.

FIG. 5 shows an exploded view of a fluid feeder tube 8 and inner and outer control sleeves 13, 14 according to the invention. The fluid feeder tube 8 comprises radial fluid feeder tube openings 20*a*, 20*b*, 20*c* for the fluid outlet line 8*b*. These radial fluid feeder openings 20*a*, 20*b*, 20*c* for the fluid outlet line 8*b* have an axial displacement with each other. The fluid feeder tube 8 comprises radial fluid feeder tube openings 21*a*, 21*b* for the fluid inlet line 8*a*. These radial fluid feeder openings 21*a*, 21*b* for the fluid inlet line 8*a* have an axial displacement to each other. Preferably, the fluid feeder tube 8 comprises two fluid inlet lines 8*a*, 8*c* and two fluid outlet lines 8*b*, 8*d*. Referring to the example in FIG. 5, all fluid inlet lines 8*a*, 8*c* in the fluid feeder tube 8 comprise the same number and type of radial fluid openings. All fluid outlet lines 8*b*, 8*d* in the fluid feeder tube 8 comprise the same number and type of openings. However, the number of radial fluid openings in the fluid feeder tube 8 may be varied to achieve a desired number of gears for the hydraulic device 1.

The fluid feeder tube 8 comprises at least one fluid inlet port 17 and at least one fluid outlet port 18*a*, 18*b* to allow for a radial inlet and outlet feed of fluid.

The inner control sleeve 13 is arranged to be disposed around the fluid feeder tube 8. The inner control sleeve 13 comprises radial inner fluid openings 22*a*, 22*b*, 22*c* which are arranged to interact with openings in the fluid feeder tube 8 and the outer control sleeve 14. These radial inner fluid openings 22*a*, 22*b*, 22*c* have an axial displacement to each other. The inner control sleeve 13 comprises radial inner fluid openings 23*a*, 23*b* which are arranged to interact with openings in the fluid feeder tube 8 and the outer control sleeve 14. These radial inner fluid openings 23*a*, 23*b* have an axial displacement with each other.

The outer control sleeve 14 is arranged to be disposed around the fluid feeder tube 8, more particularly around the inner control sleeve 13. The outer control sleeve 14 comprises radial outer fluid openings 24*a*, 24*b*, 24*c* which are arranged to interact with openings in the fluid feeder tube 8 and the inner control sleeve 13. These radial outer fluid openings 24*a*, 24*b*, 24*c* have an axial displacement to each other. The outer control sleeve 14 comprises radial outer fluid openings 25*a*, 25*b* which are arranged to interact with openings in the fluid feeder tube 8 and the inner control sleeve 13. These radial inner fluid openings 25*a*, 25*b* have an axial displacement with each other. The outer control sleeve 14 comprise annular seals 60, 61, 62, 63 on each side of the radial fluid openings of the inner and outer control sleeve 13, 14, provided such that the annular seals 60, 61, 62, 63 seals between the outer control sleeve 14 and the drive shaft cylinder 10*b*.

The fluid can be pumped through the fluid inlet lines 8*a*, 8*c* and through the radial inner and outer fluid openings of the inner and outer control sleeves 13, 14 and the drive shaft cylinder openings and into the low pressure section of the expanding and contracting volume pressure chambers 7. When the fluid is displaced between the inner rotor 4 and the outer ring 5 to the high pressure section of the expanding and contracting volume pressure chambers 7, it will be pressed out through the radial fluid feeder channels 9 and into the fluid outlet lines 8*c*, 8*d* through drive shaft cylinder openings and through the radial inner and outer fluid openings of the inner and outer control sleeves 13, 14.

Referring to FIG. 5, the fluid feeder tube 8, the inner and outer control sleeves 13, 14 comprise a plurality of fluid openings. These fluid openings may vary in size and shape. These fluid openings provide for a radial feed through the inner rotor 4 to the expanding and contracting volume pressure cambers 7.

By rotating the inner and outer control sleeve 13, 14 the radial fluid feed can be controlled and directed from the fluid feeder tube 8 to the expanding and contracting volume pressure chambers 7 and then back to the fluid feeder tube 8. The inner and outer control sleeves 13, 14 are rotated relative each other to regulate the radial fluid flow in the hydraulic device 1.

Figure 6C:
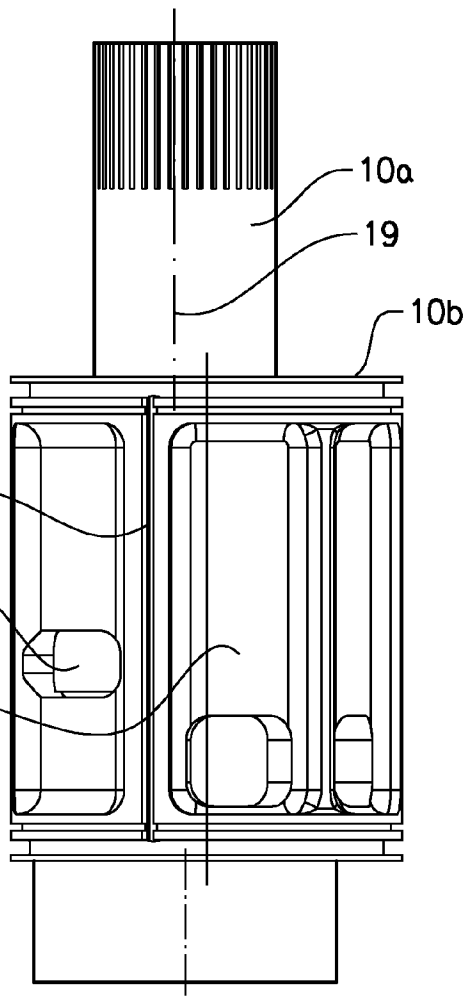
FIG. 6*c* shows a schematically view of a drive shaft cylinder according to the invention.
Figure 6B:
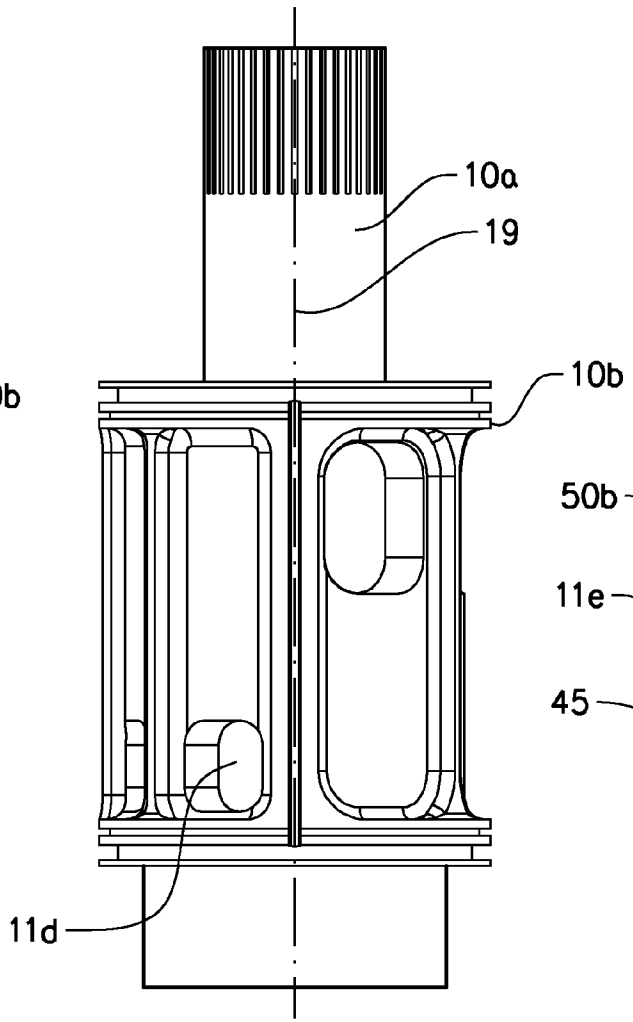
FIG. 6*b* shows a schematically view of a drive shaft cylinder according to the invention.
Figure 6A:
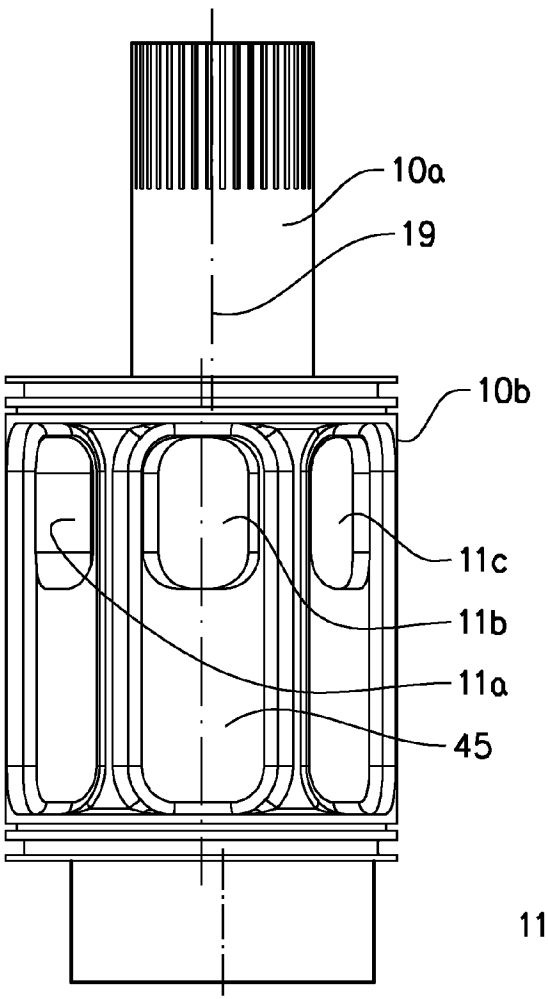
FIG. 6*a* shows a schematically view of a drive shaft cylinder according to the invention.

FIGS. 6*a*-6*c* show the drive shaft unit 10 comprising the drive shaft 10*a* and the drive shaft cylinder 10*b*. The drive shaft cylinder 10*b* comprise several radial fluid openings 11*a*, 11*b*, 11*c*, 11*d*, 11*e* and as the drive shaft cylinder 10*b* rotates, the drive shaft cylinder openings 11*a*, 11*b*, 11*c*, 11*d*, 11*e* will pass over the stationary radial fluid openings in the control sleeves 13, 14. The radial drive shaft cylinder openings 11*a*, 11*b*, 11*c*, and the radial drive shaft opening 11*d* and the radial drive shaft openings 11*e* have an axial displacement to each other. The drive shaft cylinder openings 11*a*, 11*b*, 11*c*, 11*d*, 11*e* are located in open compartments 45. FIG. 6*c* show the second vane 50*b* on the drive shaft cylinder 10*b*.

Figure 7:
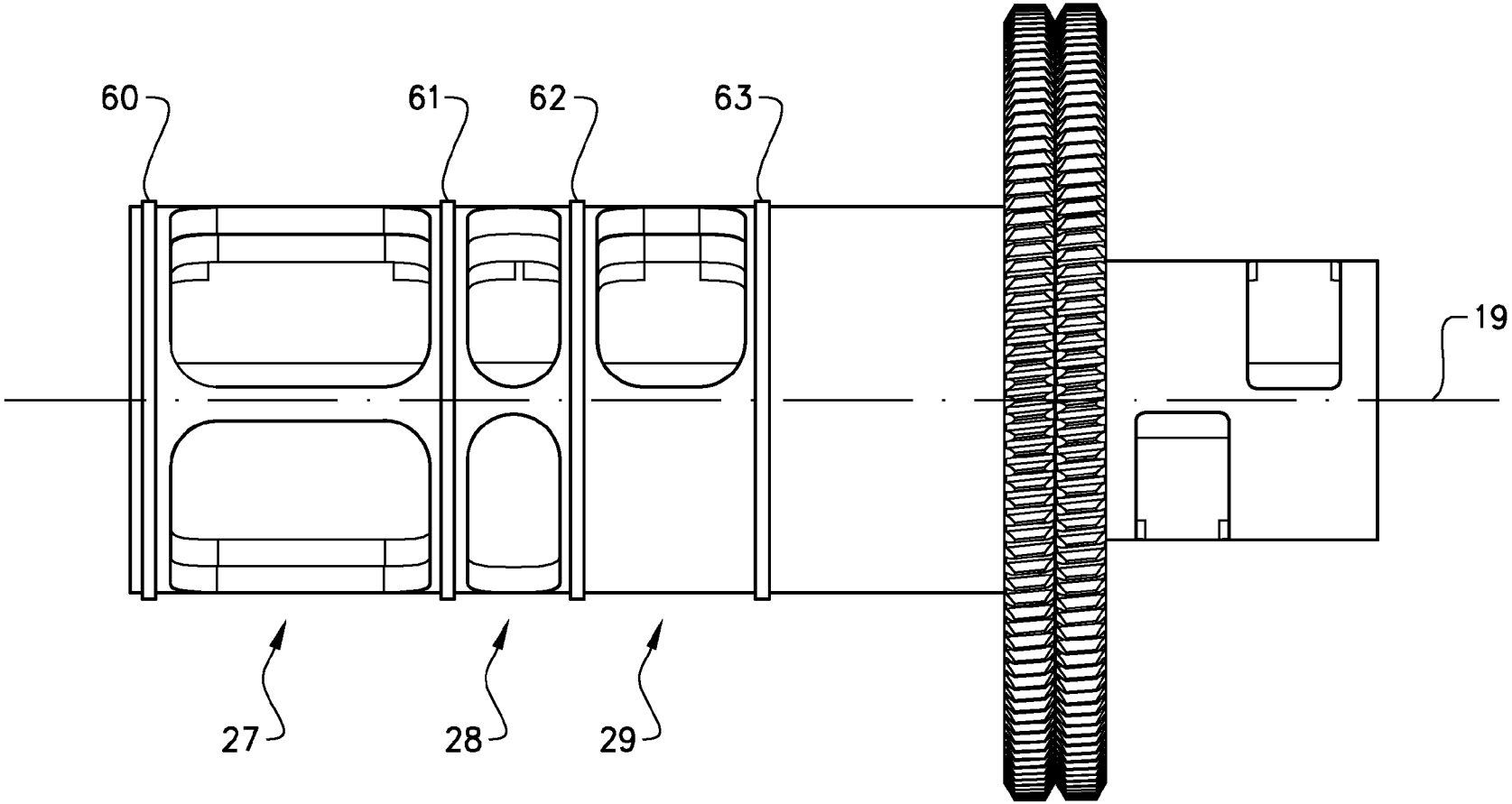
FIG. 7 shows a schematically view of a fluid feeder tube and inner and outer control sleeves according to the invention.

FIG. 7 show the inner and outer control sleeves 13, 14 around the fluid feeder tube 8 according to the invention. A first annular fluid volume 27, a second annular fluid volume 28 and a third annular fluid volume 29 can be defined when the inner and outer control sleeves 13, 14 and the drive shaft cylinder 10*b* are arranged around the fluid feeder tube 8. The annular fluid volumes 27, 28, 29 are formed between the annular seals 60, 61, 62, 63 of the outer control sleeve 14. The inner control sleeve 13 and the outer control sleeve 14 controls the annular fluid volumes 27, 28, 29, which are circular fluid volumes around the fluid feeder tube 8 which feed fluid independently of drive shaft angle. The radial fluid openings of the fluid feeder tube 8, the inner and outer control sleeves 13, 14 are defined within these three annular fluid volumes 27, 28, 29. By rotating the inner and outer control sleeves 13, 14 it is decided if a high pressure fluid inlet or outlet line, or a low pressure fluid inlet or outlet line within the fluid feeder tube 8 should be in contact with a certain annular fluid volume 27, 28, 29.

Figure 8:
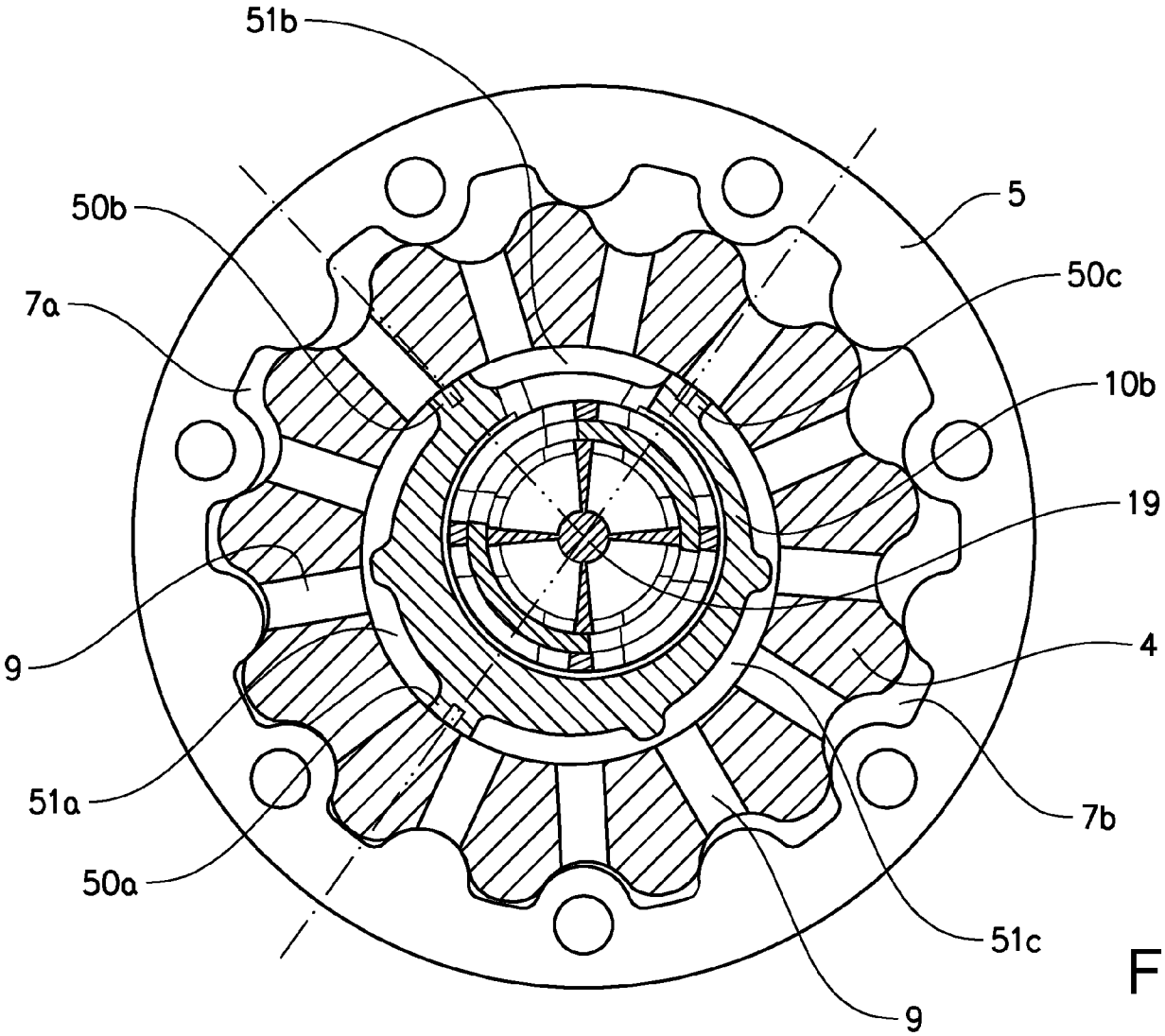
FIG. 8 shows a schematically cross section view of a gerotor according to the invention.

FIG. 8 shows a cross section of a gerotor 3 according to the invention, wherein the non-symmetrical drive shaft cylinder 10*b* is arranged around the outer control sleeve 14. The inner rotor 4 comprises radial fluid feeder channels 9 between every external lobe 4*a*.

The low and high pressure sections follow the rotation of the drive shaft cylinder 10*b*. When the drive shaft cylinder 10*b* rotates in clockwise, a high pressure section 7*a* extends in the expanding and contracting volume pressure chambers 7 from the same radial position as the first vane 50*a* is located and in the clockwise direction, to the same radial position as the third vane 50*c*. A low pressure section 7*b* extends in the expanding and contracting volume pressure chambers 7 from the same radial position as the third vane 50*c* is located and in the clockwise direction, to the same radial position as the first vane 50*a*. If the drive shaft cylinder would be rotated counterclockwise the low pressure section 7*b* and the high pressure section 7*a* would change position. The drive shaft cylinder 10*b* slides on the vanes 50*a*, 50*b*, 50*c*, which seals between the fluid feeder tube 8 and the inner rotor 4.

Three vane volumes 51*a*, 51*b*, 51*c* between the three vanes 50*a*, 50*b*, 50*c* of the drive shaft cylinder 10*b*, the annular seals 44*a*, 44*b* and the inner rotor 4 are filled with fluid. These three vane volumes 51*a*, 51*b*, 51*c* define a sealed volume. These vane volumes 51*a*, 51*b*, 51*c* are filled out by fluid which is sealed and pushed during rotating of the drive shaft cylinder 10*b* in the direction of the rotating drive shaft cylinder 10*b*. These vane volumes 51*a*, 51*b*, 51*c* are substantially proportional with the size of the radial fluid openings of the fluid feeder tube 8, the inner and outer control sleeves 13, 14 defined within the three annular fluid volumes 27, 28, 29.

Figure 9D:
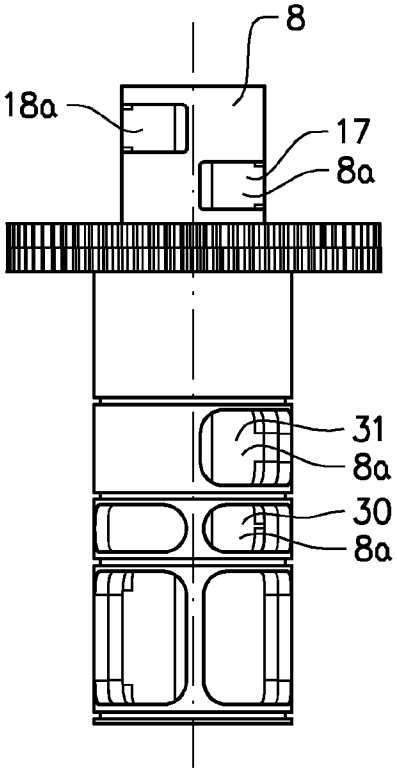
FIG. 9*d* shows a schematically view of a fourth position of the inner and outer control sleeves.
Figure 9C:
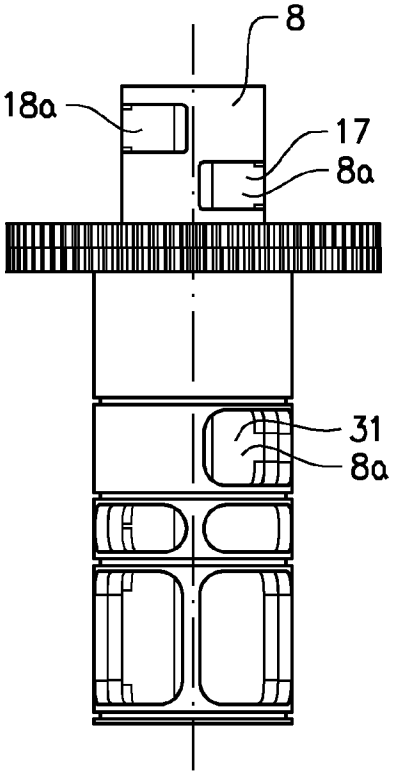
FIG. 9*c* shows a schematically view of a third position of the inner and outer control sleeves.
Figure 9B:
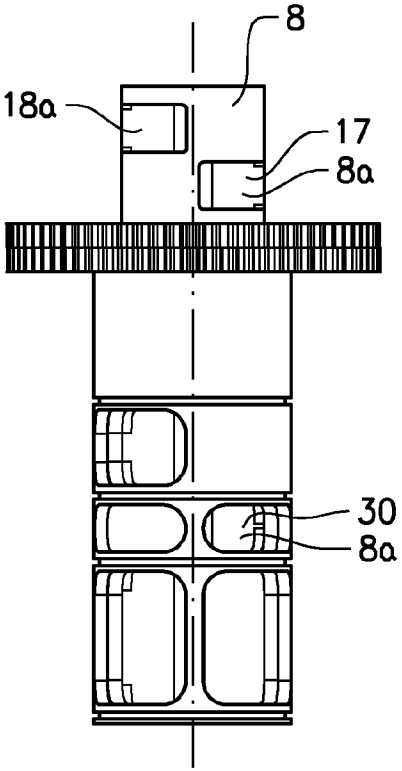
FIG. 9*b* shows a schematically view of a second position of the inner and outer control sleeves.
Figure 9A:
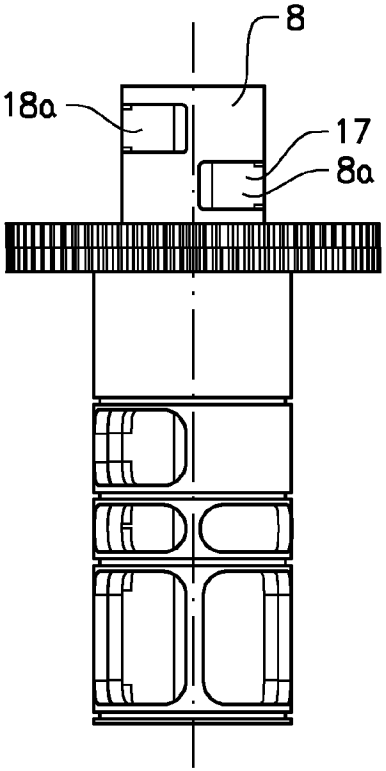
FIG. 9*a* shows a schematically view of a first position of the inner and outer control sleeves.

FIG. 9*a* show a first position of the inner and outer control sleeves 13, 14 around the fluid feeder tube 8, wherein the fluid inlet line 8*a* is closed. Whereby, no fluid is fed from the fluid inlet line 8*a*. All annular fluid volumes 27, 28, 29 are connected to low pressure fluid outlet lines 8*b*, 8*d* resulting in full recirculation. Fluid which is pumped out through the second annular fluid volume 28 and the third annular fluid volume 29 is sucked into the first annular fluid volume 27. Whereby, no fluid leaves the pump or motor.

FIG. 9*b* show a second position of the inner and outer control sleeves 13, 14 around the fluid feeder tube 8, wherein a first fluid inlet opening 30 is open to the fluid inlet line 8*a*. Whereby, fluid is fed from the fluid inlet line 8*a* to the volume pressure chambers 7. When the first fluid inlet opening 30 is open around a third of the rotational displacement is obtained.

FIG. 9*c* show a third position of the inner and outer control sleeves 13, 14 around the fluid feeder tube 8, wherein a second fluid inlet opening 31 is open to the fluid inlet line 8*a*. Whereby, fluid is fed from the fluid inlet line 8*a* to the volume pressure chambers 7. When the second fluid inlet opening 31 is open around two third of the displacement is obtained.

FIG. 9*d* show a fourth position of the inner and outer control sleeves 13, 14 around the fluid feeder tube 8, wherein the first fluid inlet opening 30 and the second fluid inlet opening 31 are open to said fluid inlet line 8*a*. Whereby, fluid is fed from the fluid inlet line 8*a* to the volume pressure chambers 7. When both the first fluid inlet opening 30 and second fluid inlet opening 31 are open the maximum displacement is obtained.

In the shown example, the normal working range of the hydraulic device is in the range of 0-5000 rpm, preferably in the range of 0-3000 rpm. In the shown example, the normal working pressure of the hydraulic device is in the range of 0-400 bar. However, the invention is not limited to the example described above, but may be modified without departing from the scope of the claims below.

The hydraulic device 1 is filled and fed with fluid and normally the fluid is oil. However, the hydraulic device 1 can also regulate the flow of gases, liquids, fluidized solids, or slurries.

The hydraulic device 1 may be used in various types of applications, such as gerotors and their transmission. One example of the inventive hydraulic device resides in the hydraulic drive of vehicle wheels.

The terminology used herein is for the purpose of describing particular examples only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

The invention should be regarded as illustrative rather than restrictive, and not as being limited to the particular examples discussed above. Reference signs mentioned in the claims should not be seen as limiting the extent of the matter protected by the claims, and their sole function is to make claims easier to understand. As will be realized, the invention is capable of modification in various obvious respects, all without departing from the scope of the appended claims. Accordingly, the drawings and the description thereto are to be regarded as illustrative in nature, and not restrictive.

The invention claimed is:

1. A hydraulic device comprising:

a housing; and a gerotor contained within the housing, the gerotor having an inner rotor eccentrically disposed within an outer ring;

wherein the outer ring has a central axis, the outer ring being stationary and fixed to the housing;

the inner rotor having external lobes extending radially outwardly engaging the outer ring having internal lobes extending radially inwardly, the inner rotor being arranged for orbital and rotational movement relative the outer ring, wherein the orbital and rotational movement will define a plurality of expanding and contracting volume pressure chambers between the inner rotor and the outer ring;

wherein the hydraulic device comprises a fluid feeder tube with a central axis common with the central axis of the outer ring, the fluid feeder tube is provided with at least one fluid inlet line and at least one fluid outlet line;

the inner rotor slides against a drive shaft cylinder, the drive shaft cylinder is connected to a drive shaft that has an axis of rotation aligned with the central axis of the outer ring, the drive shaft cylinder having a circumference which is eccentrically disposed relative the central axis of the outer ring, the inner rotor comprises at least one radial fluid feeder channel disposed radially from the centre of and through the inner rotor and out to at least one of the plurality of expanding and contracting volume pressure chambers;

wherein said fluid inlet line and said fluid outlet line respectively are radially connectable to said at least one radial fluid feeder channel for fluid communication into and out from said expanding and contracting volume pressure chambers; and wherein flow though through the at least one fluid inlet line is in an opposite direction from flow through the at least one fluid outlet line.

2. A hydraulic device according to claim 1, wherein the hydraulic device comprises fluid regulating means comprising fluid openings selectively connecting and disconnecting said fluid inlet line and said fluid outlet line to said at least one radial fluid feeder channel.

3. A hydraulic device according to claim 1, wherein said at least one radial fluid feeder channel is disposed between the external lobes of the inner rotor.

4. A hydraulic device according to claim 1, wherein the at least one radial fluid feeder channel comprises four radial fluid feeder channels disposed between each of the external lobes of the inner rotor.

5. A hydraulic device comprising:

a housing; and a gerotor contained within the housing, the gerotor having an inner rotor eccentrically disposed within an outer ring;

wherein the outer ring has a central axis, the outer ring being fixed to the housing;

the inner rotor having external lobes extending radially outwardly engaging the outer ring having internal lobes extending radially inwardly, the inner rotor being arranged for orbital and rotational movement relative the outer ring, wherein the orbital and rotational movement will define a plurality of expanding and contracting volume pressure chambers between the inner rotor and the outer ring;

wherein the hydraulic device comprises a fluid feeder tube with a central axis common with the central axis of the outer ring, the fluid feeder tube is provided with at least one fluid inlet line and at least one fluid outlet line;

the inner rotor slides against a drive shaft cylinder, the drive shaft cylinder having a circumference which is eccentrically disposed relative the central axis, the inner rotor comprises at least one radial fluid feeder channel disposed radially from the centre of and through the inner rotor and out to at least one of the plurality of expanding and contracting volume pressure chambers, wherein said fluid inlet line and said fluid outlet line respectively are radially connectable to said at least one radial fluid feeder channel for fluid communication into and out from said expanding and contracting volume pressure chambers;

wherein the hydraulic device comprises fluid regulating means comprising fluid openings selectively connecting and disconnecting said fluid inlet line and said fluid outlet line to said at least one radial fluid feeder channel;

wherein the fluid regulating means comprises the fluid feeder tube, an inner control sleeve and an outer control sleeve, and the drive shaft cylinder; and wherein the inner control sleeve and the outer control sleeve are selectively and separately positionable relative to the drive shaft cylinder to selectively connect and disconnect said fluid inlet line and said fluid outlet line to said at least one radial fluid feeder channel, to regulate flow between said at least one radial fluid feeder channel, and said fluid inlet line and said fluid outlet line.

6. A hydraulic device according to claim 5, wherein the inner control sleeve and the outer control sleeve are provided between the fluid feeder tube and the inner rotor;

wherein the inner control sleeve and the outer control sleeve are selectively displaceable and arranged to radially connect said fluid inlet line and said fluid outlet line to said at least one radial fluid feeder channel to regulate radial fluid feed through the inner rotor to said expanding and contracting volume pressure cambers.

7. A hydraulic device according to claim 5, wherein the inner control sleeve comprises inner fluid openings and the outer control sleeve comprises outer fluid openings adapted to connect and disconnect said fluid inlet line and said fluid outlet line to said at least one radial fluid feeder channel.

8. A hydraulic device according to claim 5, wherein the inner and outer control sleeves are displaceable around the fluid feeder tube.

9. A hydraulic device according to claim 5, wherein the inner and outer control sleeves are displaceable to a first position in which said fluid inlet line is closed.

10. A hydraulic device according to claim 5, wherein the inner and outer control sleeves are displaceable to a second position in which a first fluid inlet opening is open to said fluid inlet line.

11. A hydraulic device according to claim 5, wherein the inner and outer control sleeves are displaceable to a third position in which a second fluid inlet opening is open to said fluid inlet line.

12. A hydraulic device according to claim 5, wherein the inner and outer control sleeves are displaceable to a fourth position in which a first fluid inlet opening and a second fluid inlet opening are open to said fluid inlet line.

13. A hydraulic device according to claim 5, wherein a drive shaft unit comprises a drive shaft extending from the drive shaft cylinder and having an axis of rotation aligned with the central axis of the outer ring;

wherein the drive shaft cylinder is provided between the fluid feeder tube and the inner rotor, the drive shaft cylinder having a circumference which is eccentrically disposed relative the central axis;

wherein the drive shaft cylinder is arranged to radially connect said fluid inlet line and said fluid outlet line to said at least one radial fluid feeder channel to allow for a regulated radial fluid feed through the inner rotor to said expanding and contracting volume pressure cambers.

14. A hydraulic device according to claim 5, wherein the drive shaft cylinder is provided with at least one drive shaft cylinder opening to allow for a regulated radial feed through the inner rotor to said expanding and contracting volume pressure cambers.

15. A hydraulic device according to claim 5, wherein the fluid feeder tube comprises at least one feeder tube fluid opening to allow for a radial fluid feed between said fluid inlet line and said fluid outlet line through the inner rotor to said expanding and contracting volume pressure cambers.

16. A hydraulic device according to claim 5, wherein the fluid feeder tube comprises at least one fluid inlet port and at least one fluid outlet port to allow for a radial inlet and outlet feed of fluid.

17. A hydraulic device according to claim 5, wherein the fluid feeder tube is fixed to the housing.

18. A hydraulic device according to claim 5, wherein said fluid inlet line and said fluid outlet line in the fluid feeder tube are symmetrical.

19. A hydraulic device according to claim 5, wherein the at least one fluid inlet line of the fluid feeder tube comprises two fluid inlet lines, and wherein the at least one fluid outlet line of the feeder tube comprises two fluid outlet lines.

20. A hydraulic device according to claim 5, wherein the inner control sleeve and the outer control sleeve are arranged to cooperate with the fluid feeder tube, the drive shaft cylinder and said at least one radial fluid feeder channel to define a fluid recirculation region.

21. A hydraulic device according to claim 5, wherein the hydraulic device is a hydraulic motor.

22. A hydraulic device according to claim 5, wherein the hydraulic device is a hydraulic pump.

* * * * *